US005421180A

United States Patent [19]

Rojdev

[11] Patent Number: 5,421,180

[45] Date of Patent: Jun. 6, 1995

[54] CASKET LOCKING CRANK COLLAPSIBLE INTO COMPACT CONFIGURATION

[75] Inventor: Ilija Rojdev, Cincinnati, Ohio

[73] Assignee: Batesville Casket Company, Inc., Batesville, Ind.

[21] Appl. No.: 184,000

[22] Filed: Jan. 18, 1994

Related U.S. Application Data

[63] Continuation of Ser. No. 957,238, Oct. 6, 1992, abandoned.

[51] Int. Cl.[6] ..... A47G 29/10

[52] U.S. Cl. ..... 70/456 R; 74/527; 74/528; 74/531; 74/547; 74/557; 81/28; 81/177.6

[58] Field of Search ..... 70/408, 401, 456 R, 70/396, 399; 81/28, 30, 35, 37, 73, 177.2, 177.4, 177.6, 177.7, 36, 177.8; 74/547, 527, 528, 531, 557

[56] References Cited

U.S. PATENT DOCUMENTS

| | | | |
|---|---|---|---|
| 16,938 | 3/1857 | Streeter | 81/35 |
| 274,658 | 3/1883 | Rees et al. | 70/409 |
| 652,414 | 6/1900 | Wilson | 81/177.6 X |
| 733,203 | 7/1903 | Horgan | 70/408 |
| 1,225,822 | 5/1917 | Kimball | 81/177.6 |
| 1,642,791 | 9/1927 | Skorepa | 70/456 R |
| 1,777,929 | 10/1930 | McCaul | 70/456 R |
| 2,503,373 | 4/1950 | Browning et al. | 81/177.7 |
| 2,563,126 | 8/1951 | Marogg | 81/177.6 X |
| 2,589,571 | 3/1952 | Queen | 70/456 R |
| 2,595,981 | 5/1952 | Prickett et al. | 70/456 R |
| 2,607,210 | 8/1952 | Chesak | 70/456 R |
| 2,630,212 | 3/1953 | Mosch | 70/456 R X |
| 2,790,319 | 4/1957 | Brunner | 70/456 R |
| 2,795,128 | 6/1957 | Ly | 70/456 R |
| 2,924,961 | 2/1960 | Pyper | 70/456 R |
| 2,951,405 | 9/1960 | Engquist | 81/177.8 X |
| 3,079,784 | 3/1963 | Pavlowski | 70/456 R |
| 3,606,777 | 9/1971 | Watson | 70/456 R X |
| 4,334,445 | 6/1982 | Timewell | 81/177.7 |
| 4,440,048 | 4/1984 | Stevens et al. | 81/177.4 X |
| 4,607,406 | 8/1986 | Davis, Jr. | 81/177.6 X |
| 4,744,272 | 5/1988 | Leatherman | 81/177.6 X |
| 4,909,054 | 3/1990 | Fox | 70/401 |

FOREIGN PATENT DOCUMENTS

| | | | |
|---|---|---|---|
| 294821 | 6/1936 | Italy | 81/177.6 |
| 464825 | 7/1951 | Italy | 70/456 R |
| 2050899 | 1/1981 | United Kingdom | 81/177.7 |

*Primary Examiner*—Lloyd A. Gall
*Attorney, Agent, or Firm*—Wood, Herron & Evans

[57] ABSTRACT

A collapsible locking crank for use in locking burial caskets including a body pivotally housing a crank key arm and crank handle. The crank key arm includes a hexagonal key head on its free end for engaging the locking mechanism of the casket. The arm and handle may be pivoted away from the body to an open, operative position and toward the body to a closed, inoperative position. Rotation of the crank key arm about its longitudinal axis is had by rotation of the crank handle through the crank body when the crank is configured into a generally Z-shape. The crank is compact and lightweight for discrete and dignified use.

7 Claims, 2 Drawing Sheets

CASKET LOCKING CRANK COLLAPSIBLE INTO COMPACT CONFIGURATION

RELATED APPLICATIONS

This application is a continuation of application Ser. No. 07/957,238 filed Oct. 6, 1992, now abandoned.

BACKGROUND OF THE INVENTION

This invention relates to the field of caskets, and more particularly to a casket locking crank for actuating the casket locking mechanism to lock the cap of a casket closed.

Burial caskets customarily have a shell or body and a cap or lid, the cap fitting closely to the body when the casket is closed. A locking mechanism on the casket shell assures that once the casket cap is closed, it is held firmly against the shell. In a funeral home, at the conclusion of a visitation period, it is customary for the funeral director to close and lock the casket lid with a somewhat bulky, rigid locking crank which includes a locking mechanism actuating key thereon. The casket lid may be locked closed for a specified number of years for public health reasons, which also adds comfort and solace to the family and loved ones of the deceased. Once the casket is locked, a common industry practice is for the funeral director to present the casket locking crank, normally ornate in appearance, to the deceased's family or loved ones as a memorial of the service.

The disadvantage of current casket locking cranks is that they are large, excessively cumbersome, and exceedingly heavy for the funeral director when carried, for example, in a coat pocket.

SUMMARY OF THE INVENTION

It has been an objective of the present invention to provide a casket locking crank for locking a casket lid closed, which may be opened for engagement with the casket locking mechanism and rotated or cranked to lock the lid to the casket shell and which may then be collapsed or closed to form a compact and lightweight article for the funeral director to use and then store in a pocket in a compact, unobtrusive, and comfortable manner.

This objective of the invention is obtained by a collapsible locking crank which can be opened into a generally L-shape for rotation or a generally Z-shape for use in a crank-like manner by the funeral director for locking the casket. The crank can then be collapsed or closed for easy carrying. In a presently preferred embodiment of the invention, the crank includes a lightweight body made of a durable and inexpensive material, for example, a plastic; a crank key arm pivoted to one end of the body; and a cranklhandle pivoted to the other end of the crank body. The crank key arm and crank handle may be pivoted away from the body in the crank open condition and then pivoted into longitudinal recesses on either side of the body in the crank closed condition. The head of the crank key arm opposite the pivot is shaped, for example, with a hexagonal-shaped key head or some other configuration which is compatible with the casket manufacturer's lock, to engage or disengage the locking mechanism on the casket. The crank key arm may be constructed of a suitable material which will not easily wear and deteriorate from repeated use, for example, cold-rolled steel. The crank handle is generally cylindrical in configuration and also manufactured of a durable and inexpensive material such as a plastic.

When the crank is opened, the crank body, crank key arm, and crank handle form a generally Z-shaped crank for the funeral director to crank the casket cap closed and locked. The Z-shaped crank is less awkward for the funeral director to use than a standard Allen or L-shaped crank and therefore more in keeping with the funeral service setting.

Alternatively, only the crank key arm may be pivoted from the body for the funeral director to rotate it, e.g., a ¼ turn, in the casket lock to lock the casket cap to the casket shell.

The crank body has two longitudinal recesses or troughs on opposite sides for receiving the handle and arm in the crank closed position. This creates a compact and streamlined closed crank which the funeral director can easily carry in a pocket.

A stop is provided at each end of the troughs to support the handle and key arm in a specific angular orientation when those elements are pivoted to the crank open condition. Specifically, when opened, the handle and arm each form a generally 105° angle with respect to the longitudinal axis of the body. The 105° angle is employed to avoid interference with any rounded edges on the casket shell on rotation of the crank in the casket lock. Further, at the end of each trough adjacent the pivot, the transverse dimension is reduced slightly by the presence of an integrally molded rib which engage dimples on the handle and arm, respectively, to hold them when pivoted to the crank open position.

Summarizing, when the crank is opened, it is a sturdy and reliable tool for locking and unlocking a casket cap. Once closed, the crank forms a compact and lightweight article for discrete storage in the pocket of a funeral director. The present invention, therefore, offers a lightweight, compact, and durable casket locking crank for discrete and dignified use by the funeral director heretofore not available in the casket industry.

DETAILED DESCRIPTION OF THE INVENTION

Figure 1:
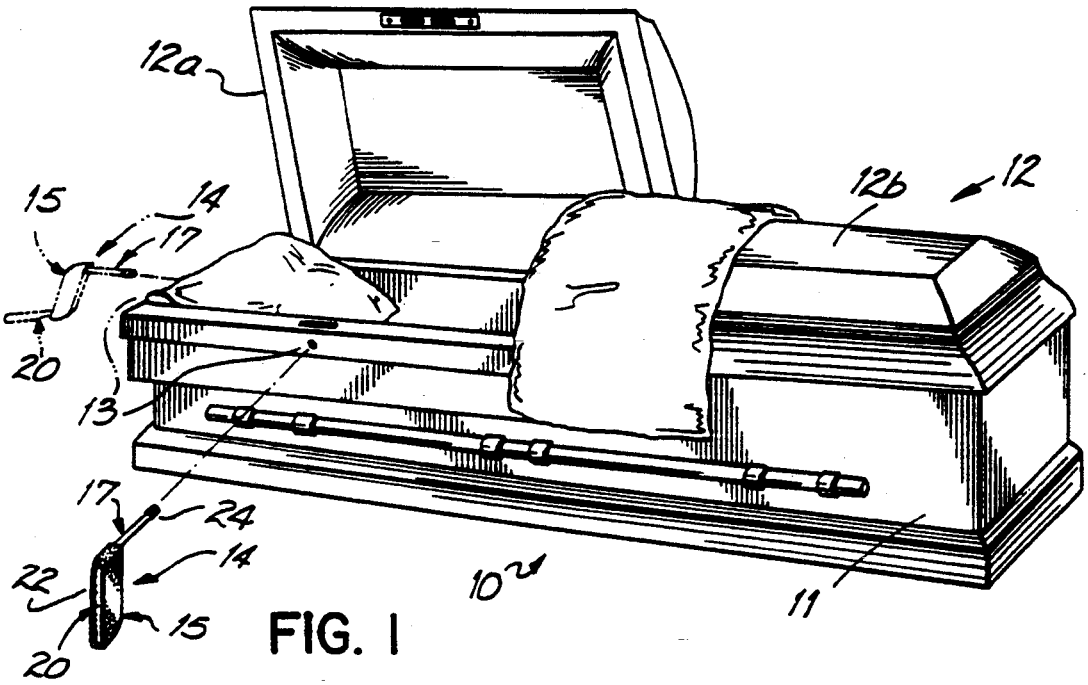
FIG. 1 is a perspective view of a casket and the casket locking crank of the present invention.
Figure 5:
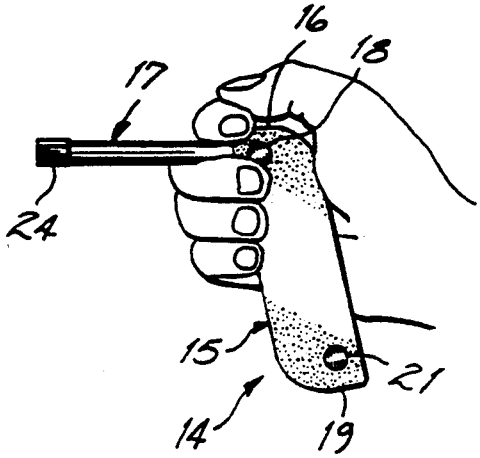

Referring to FIG. 1, a casket 10 has a shell 11 and a casket cap 12, constructed, for example, of wood. The casket cap 12 is split into sections 12*a*, 12*b* and each section is hinged to the shell 11 and can be secured closed by a locking mechanism, for example, lock 13. The lock 13 is operated by a casket locking crank 14. In wood caskets, locks 13 are located in the shell 11 on the side of the casket adjacent the shell/cap interface. These locks are typically locked by a ¼ turn of the locking crank 14, as depicted in FIGS. 1 and 5 and as more fully described below. In the case of metal caskets, there is a single lock 13 at the end of the casket which locks both cap sections closed. These locks are operated by cranking a number of turns, e.g., 28 turns, to draw the caps tightly down on the shell. In FIG. 1, the crank 14 is shown in phantom to illustrate its orientation when used with metal caskets.

Figure 2A:
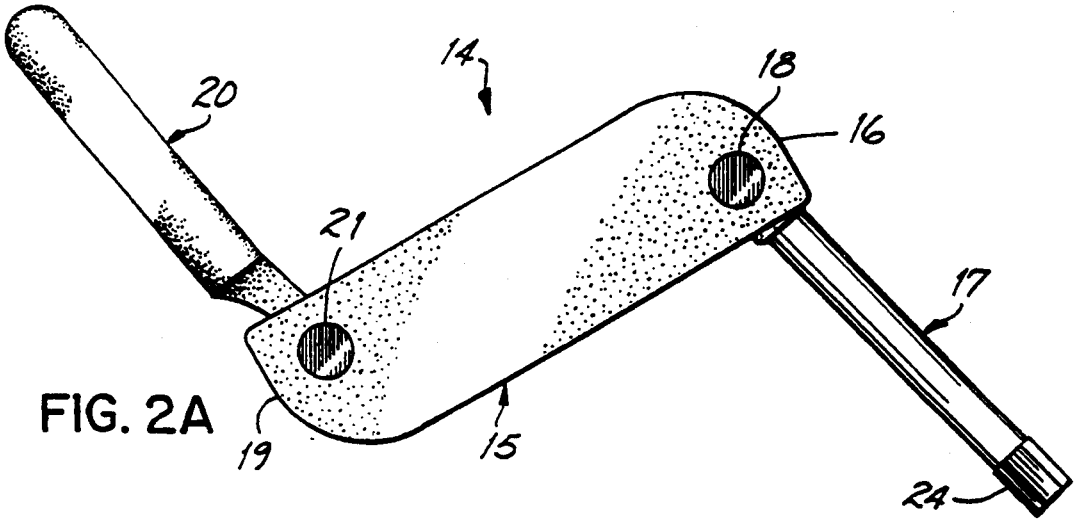
FIG. 2A is a plan view of the casket locking crank of the present invention depicting it in the key arm open condition.
Figure 2B:
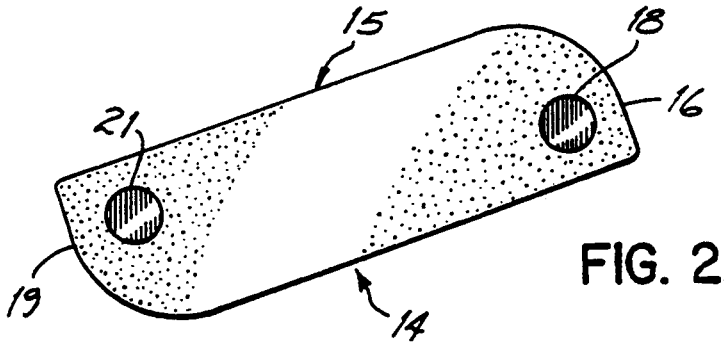
FIG. 2B is a plan view of the casket key shown in FIG. 2A in the key arm closed condition.
Figure 3:
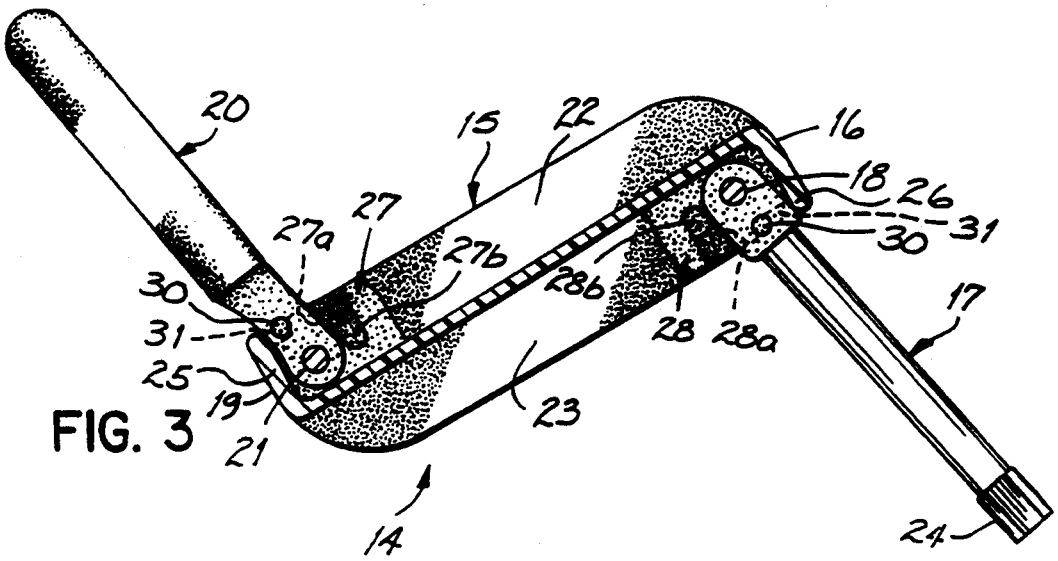
FIG. 3 is a plan view of the key shown in FIG. 2A with the locking crank body shown in cross-section.

Referring to FIGS. 2A, 2B, and 3, the casket locking crank 14 has an elongated crank body 15 made of a lightweight plastic, in the presently preferred form of the invention. The body 15 has an end 16 to which a crank key arm 17 is pivotally attached with a rivet 18. The body 15 has an opposite end 19 to which a cylindrical crank handle 20 is pivotally attached by another rivet 21. The handle 20 and key arm 17 individually pivot toward and away from the body 15. When pivoted away from the body 15, the key arm 17 extends therefrom to engage the casket lock mechanism. See FIG. 5. At the opposite end of the body 15, the handle 20 may be fully extended for grasping by a user's hand. When pivoted away from the body 15, the handle 20 extends therefrom for grasping by a user. See FIG. 4. In the crank open position shown in FIG. 2A, the crank key arm 17 and crank handle 20 each form an angle of about 105° with the longitudinal axis of the crank body. In this configuration, which may be characterized as a generally Z-shaped configuration, the key arm 17 can be rotated about its longitudinal axis by turning the body 15 by means of rotation of the handle 20. Thus key arm 17 is rotated about its longitudinal axis by rotation of handle 20 through body 15.

As may be best seen in FIG. 3, the body 15 includes longitudinal recesses or troughs 22, 23 on opposite sides of the body. The trough 22 receives and houses the handle 20 while the trough 23 receives and houses the key arm 17 in the crank closed condition whereby both the crank handle 20 and crank key arm 17 are housed within the confines of the crank body 15.

The crank key arm 17 has at its end opposite pivot 18 a key head 24 of suitable configuration, such as a hexagonal-shaped key head, which will engage the casket locking mechanism and be operative to rotate the locking mechanism to the casket closed and locked condition on rotation of the crank handle 20.

In the crank open condition, the handle 20 and key arm 17 pivot outwardly away from the body 15 until they reach a stop 25, 26 at the respective ends of trough 22 and trough 23. Integrally molded ribs 27, 28 are provided at each end of trough 22 and trough 23, respectively. The ribs 27, 28 are contoured and are raised from the walls of troughs 22, 23 thereby reducing the transverse dimension of the troughs 22, 23 somewhat. The crank key arm 17 and crank handle 20 each have a pair of outwardly projecting, oppositely disposed dimples 30 which under hand force engage and ride over the ribs 27, 28. In the crank open condition, the dimples 30 ride up over portions **27*a*, 28*a* and are retained in a slot 31 therebehind to hold the arm 17 and handle 20 in the open condition. In the crank closed condition, the dimples 30 again ride over the portions 27*a*, 28*a* and frictionally engage small raised pads 27*b*, 28*b* to hold the arm 17 and handle 20 in the troughs 22, 23**.

In use, the funeral director retrieves the closed casket locking crank (FIG. 2B) from his pocket. The casket crank is easily opened by pivoting the handle 20 and key arm 17 out of the recesses 22, 23 in the crank body to the crank open condition (FIG. 2A). In this condition, the crank handle 20 and crank key arm 17 with crank body 15 form a generally Z-shaped configuration. The dimples 30 on the opposite ends of the handle 20 and arm 17 engage the rib portions **27*a*, 28*a* to hold the crank 14 in the open condition. Once the casket cap 12*a* is closed, the key head 24 of the key arm 17 is inserted into the casket's lock 13. The funeral director then grasps the crank body 15 or preferably the handle 20 and rotates the crank 14 until the cap 12*a* is securely locked. Rotation of the crank 14 in the lock 13 is not obstructed by any rounded edges or decorative features on the casket shell 11 because of the 105° angle of the arm and handle. After the casket cap 12*a* is locked, the funeral director removes key head 24 from the lock 13 and collapses or closes the casket locking crank 14. Once closed, the crank 14** can be returned to the funeral director's pocket where it can be comfortably and discreetly carried.

Figure 4:
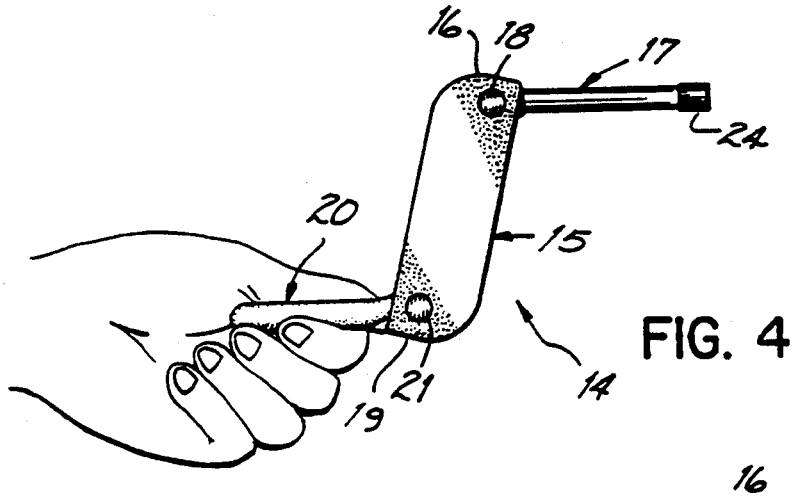
FIGS. 4 and 5 are pictorial views depicting the various ways of using the casket locking crank of the present invention.

As illustrated in FIG. 4, rotation of the crank key arm 17 is effected by the funeral director's grasping the crank handle 20 and rotating it thereby rotating the crank body 15. This method is preferred for use with metal caskets. As shown in FIG. 5, alternatively, the crank handle 20 can remain closed with only the key arm 17 open. This method is preferred for wood caskets. The funeral director merely grasps the crank body 15 and rotates it a partial turn to effect rotation of the crank key arm 17 and locking of the casket lock 13.

Thus having described the invention, what is claimed is:

1. For use with a casket having a locking mechanism, a collapsible locking crank comprising:

an elongated body having first and second ends, a crank handle pivoted to said first end for swinging movement between a closed inoperative position in which said crank handle lies against a first side of said body and an open operative position in which said crank handle is extended away from said body's first side, and a crank key arm having an end configured to engage the locking mechanism, said crank key arm being pivoted to said second end for swinging movement between a closed inoperative position in which said crank key arm lies against a second opposite side of said body and an open operative position in which said crank key arm is extended away from said body's second side, said first and second body sides each having a trough for stowing a respective one of said crank handle and crank key arm, each said trough having a projection defining first and second portions projecting inwardly from a side wall of said trough, each said crank handle and crank key arm having a projection cooperable with said first and second projection portions of a respective one of said troughs, said crank handle and said crank key arm being so disposed relative to said elongated body that when pivoted to their respective operative positions, said locking crank is configured into a generally Z-shape thereby facilitating rotation of said crank key arm about its longitudinal axis by rotation of said crank handle acting through said body, each of said crank handle and key arm projections moving over and past a respective trough first projection portion to said operable position, each of said crank handle and key arm projections moving to atop a respective trough second projection portion in said inoperable position.

2. A collapsible locking crank as in claim 1, in which said body's first and second ends each have stop means for bracing said crank handle and said crank key arm in said open positions.

3. A collapsible locking crank as in claim 2, in which said stop means limit movement of said crank handle and said crank key arm to about a 105° angle with respect to a longitudinal axis of said body.

4. A collapsible locking crank as in claim 1, in which said crank key arm end is a hex key head.

5. A collapsible locking crank as in claim 1, in which said crank handle is cylindrical.

6. A collapsible locking crank as in claim 1 wherein said first and second trough projection portions and said crank handle and crank key arm projections comprise:

a transverse rib adjacent the pivot axis of said crank handle and said crank key arm, respectively, and spaced from an end wall of a respective one of said troughs, a raised pad on the opposite side of said transverse rib from said trough end wall, a dimple at an end of each said crank handle and said crank key arm, respectively, said dimples and ribs cooperating to form detents that hold said crank handle and said crank key arm in said open position, each said dimple being located between a respective transverse rib and a trough end wall when said crank handle and crank key arm are in said open position, each said dimple being located atop a respective raised pad when said crank handle and crank key arm are in said closed position.

7. For use with a casket having a locking mechanism, a collapsible looking crank comprising:

an elongated body having first and second ends and opposite first and second sides, said first and second sides each having an elongated trough, each said trough having first and second projection portions projecting inwardly from a side wall of said trough, a cylindrical crank handle pivoted to said first end on said first side, said crank handle being capable of swinging between a closed inoperative position when housed in said trough and an open operative position when extended away from said body's first side, a crank key arm terminating in a hex key head at a free end spaced from a pivoted end, said crank key arm pivoted end being pivoted to said second end on said second side of said body, said crank key arm being capable of swinging between a closed inoperative position when housed in said trough and an open operative position when extended away from said body's second side;

each said crank handle and crank key arm having a projection cooperable with said first and second projection portions of a respective one of said troughs, an end wall of each said trough forming a stop at an end of each said trough limiting movement of said crank handle and said crank key arm each to about a 105° angle with respect to a longitudinal axis of said body, said first and second trough projection portions comprising a transverse rib in each said trough adjacent the pivot axis of said crank handle and said crank key arm, respectively, and spaced from said end wall of a respective one of said troughs and a raised pad on the opposite side of said transverse rib from said trough end wall, said crank handle and crank key arm projection comprising a dimple at an end of each said handle and said arm, respectively, said dimples and ribs cooperating to form detents that hold said crank handle and said crank key arm in said open position, each said dimple being located between a respective transverse rib and a trough end wall when said crank handle and crank key arm are in said open position, each said dimple being located atop a respective raised pad when said crank handle and crank key arm are in said closed position, said crank handle and said crank key arm being so disposed relative to said elongated body that when pivoted to their respective operative positions, said locking crank is configured into a generally Z-shape thereby facilitating rotation of said crank key arm about its longitudinal axis by rotation of said crank handle acting through said body.

* * * * *

UNITED STATES PATENT AND TRADEMARK OFFICE

CERTIFICATE OF CORRECTION

PATENT NO. : 5,421,180

DATED : Jun. 6, 1995

INVENTOR(S) : Ilija Rojdev

It is certified that error appears in the above-indentified patent and that said Letters Patent is hereby corrected as shown below:

Col. 1, line 55, "cranklhandle" should be -- crank handle --.

Col. 5, line 31, "looking" should be -- locking --.

Signed and Sealed this

Nineteenth Day of September, 1995

*Attest:*

Bruce Lehman

BRUCE LEHMAN

*Attesting Officer*

*Commissioner of Patents and Trademarks*